US007114315B2

(12) United States Patent
Chang

(10) Patent No.: US 7,114,315 B2
(45) Date of Patent: Oct. 3, 2006

(54) NONSLIP ARTICLE FOR A STIRRUP

(75) Inventor: Chia Wei Chang, Moreno Valley, CA (US)

(73) Assignee: Eastwest International (Taiwan) Enterprises, Taichung (TW)

( * ) Notice: Subject to any disclaimer, the term of this patent is extended or adjusted under 35 U.S.C. 154(b) by 0 days.

(21) Appl. No.: 10/975,218

(22) Filed: Oct. 28, 2004

(65) Prior Publication Data

US 2005/0081493 A1 Apr. 21, 2005

Related U.S. Application Data

(63) Continuation-in-part of application No. 10/899,473, filed on Jul. 26, 2004, which is a continuation-in-part of application No. 10/367,107, filed on Feb. 14, 2003, now Pat. No. 6,766,632, which is a continuation-in-part of application No. 10/056,561, filed on Jan. 25, 2002, now abandoned.

(51) Int. Cl.
*B68C 3/00* (2006.01)

(52) U.S. Cl. ..... 54/48; 54/47

(58) Field of Classification Search ..... 119/526; 54/47, 48, 49; 15/215, 216
See application file for complete search history.

(56) References Cited

U.S. PATENT DOCUMENTS

| | | | | |
|---|---|---|---|---|
| 33,354 | A | 9/1861 | Livingston | |
| 103,031 | A | 5/1870 | Dunnagan | |
| 202,974 | A | 4/1878 | Wiley | |
| 222,556 | A | 12/1879 | Whitman | |
| 376,526 | A | 1/1888 | Jennings et al. | |
| 1,160,082 | A | 11/1915 | Jarvis | |
| 1,622,510 | A | 3/1927 | Hendriks | |
| 1,639,073 | A | 8/1927 | Berbaum | |
| 2,098,141 | A | 11/1937 | Galbreath | 54/48 |
| 2,187,983 | A | 1/1940 | Moore | 54/47 |
| 3,804,216 | A | 4/1974 | Katsumori et al. | 188/314 |
| 3,905,179 | A | 9/1975 | Bischeltsrieder | 54/47 |
| 4,199,639 | A | 4/1980 | Rone | 428/138 |
| 4,936,081 | A | 6/1990 | Jones | 54/48 |
| 5,172,538 | A | 12/1992 | Luger | 54/47 |
| 5,429,854 | A * | 7/1995 | Currie et al. | 15/215 |
| 5,930,986 | A | 8/1999 | Meaghan et al. | 54/47 |
| 5,979,149 | A | 11/1999 | Martin | 54/49 |
| 6,062,007 | A | 5/2000 | Cargill | 54/47 |
| 6,220,004 | B1 | 4/2001 | Hsi-Chang | 54/48 |
| 6,425,230 | B1 | 7/2002 | Vollmecke et al. | 54/48 |
| RE38,422 | E * | 2/2004 | Rockwell et al. | 15/215 |
| 6,766,632 | B1 | 7/2004 | Chang | 54/48 |
| 6,933,036 | B1 * | 8/2005 | Whitaker | 15/215 |
| 2001/0045084 | A1 | 11/2001 | Vollmecke et al. | 54/47 |
| 2005/0039424 | A1 * | 2/2005 | Zucchini | 54/47 |

FOREIGN PATENT DOCUMENTS

| | | |
|---|---|---|
| DE | 3317859 A1 | 11/1984 |
| WO | WO 95/25692 | 9/1995 |

* cited by examiner

*Primary Examiner*—Teri Pham Luu
*Assistant Examiner*—Elizabeth Shaw
(74) *Attorney, Agent, or Firm*—Antonio R. Durando

(57) ABSTRACT

A stirrup includes a footrest as well as a hanger for suspending the stirrup from a saddle. A shock absorber is provided for the footrest and has protrusions which impart a nonslip character to the shock absorber. The protrusions have respective ends which face away from the shock absorber, and each of these ends is formed with a concavity.

20 Claims, 11 Drawing Sheets

NONSLIP ARTICLE FOR A STIRRUP

REFERENCE TO RELATED APPLICATIONS

This is a continuation-in-part of application Ser. No. 10/899,473 filed Jul. 26, 2004 filed by Chia Wei Chang for "Stirrup With Footrest Having A Gas Filled Shock Absorber" which, in turn, is a continuation-in-part of application Ser. No. 10/367,107 filed 14 Feb. 2003 by Chia Wei Chang for "Stirrup With Relatively Movable Footrest and Hanger", now U.S. Pat. No. 6,766,632, which, in turn, is a continuation-in-part of application Ser. No. 10/056,561 filed 25 Jan. 2002 by Chang Hsi-Chang for "Stirrup With Clamped Shock-Absorbing Pads", now abandoned.

BACKGROUND OF THE INVENTION

1. Field of the Invention

The invention relates to a nonslip article for a stirrup and to a stirrup equipped with the nonslip article.

2. Description of the Prior Art

Stirrups come in different forms. The above-referenced applications disclose a type of stirrup having a metallic footrest and a metallic hanger for suspending the stirrup from a saddle. The footrest is provided with an opening which is used to mount one or more shock absorbers on the footrest. An uppermost surface of the shock absorber or shock absorbers is nonslip to prevent the foot of a rider from sliding out of the stirrup.

SUMMARY OF THE INVENTION

One aspect of the invention resides in a nonslip article for the footrest of a stirrup. The article comprises a base, which can be flexible, and a plurality of protrusions on the base. Each of the protrusions has a first end connected to the base and a second end facing away from the base, and each of the second ends is provided with a depression. The protrusions can, for example, be frustoconical.

The nonslip article can further comprise a body having means for anchoring the body to the footrest of a stirrup and the base can then be designed to be mounted on the body. Such body, or at least the major part thereof, is advantageously inflated with gas. A preferred gas for inflating the body is air.

The means for anchoring the body to the footrest of a stirrup may include at least one space which can be slot-like. The body may be elongated and have opposite longitudinal ends and, in such an event, the anchoring means can comprise a space at each of these ends.

The body may be provided with one or more ribs which function to position the body on the footrest of a stirrup. Alternatively or in addition, the body can be formed with one or more recesses which serve the same purpose.

It is also possible for the body to have a rim or a flange for positioning the body on the footrest of a stirrup.

Another aspect of the invention resides in a stirrup which is provided with the nonslip article outlined above. The stirrup comprises a support for a foot as well as a suspending element for suspending the support on an animal, and the nonslip article is mounted on the support.

Additional features and advantages of the invention will be forthcoming from the following detailed description of specific embodiments when read in conjunction with the accompanying drawings.

DESCRIPTION OF THE PREFERRED EMBODIMENTS

Figure 1:
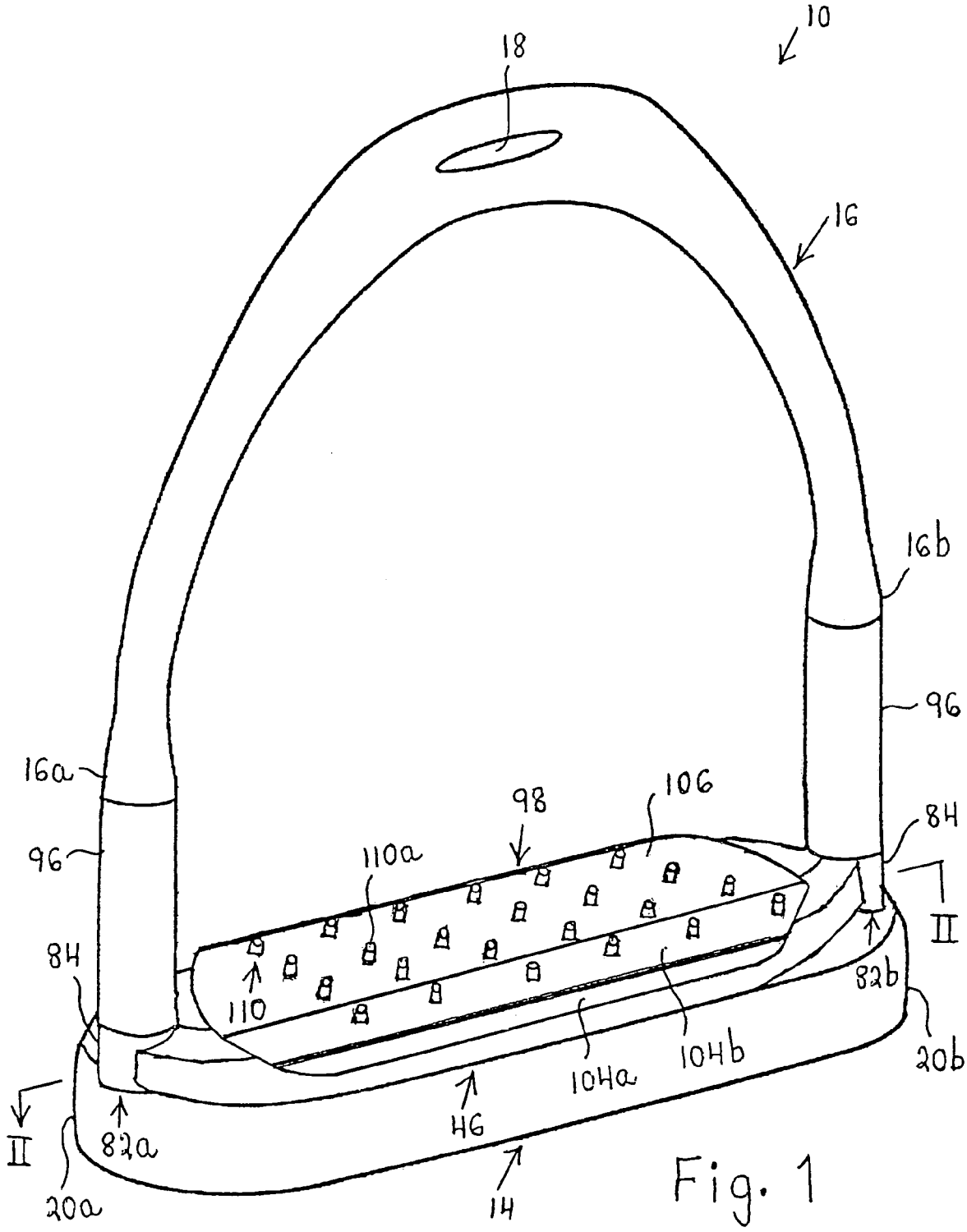
FIG. 1 is a perspective view of one embodiment of a stirrup which is designed in accordance with the invention and includes a footrest, a shock-absorbing body on the footrest and a nonslip tread overlying the shock-absorbing body.
Figure 2:
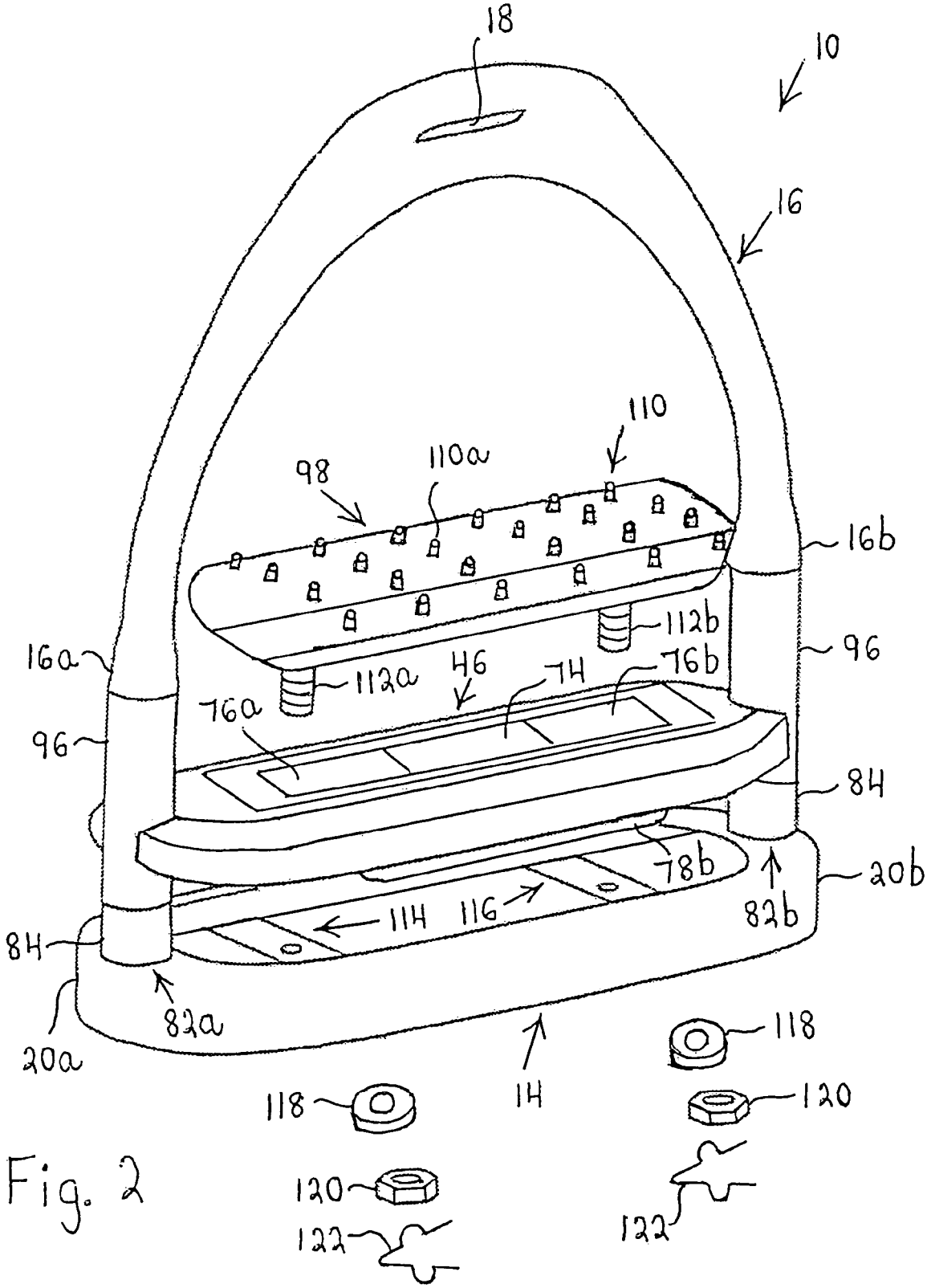
FIG. 2 is a partially exploded perspective view of the stirrup of FIG. 1.

Referring to FIGS. 1 and 2, the numeral 10 identifies a stirrup according to the invention. The stirrup 10 includes a rigid metallic footrest 14 which constitutes a support for a foot and a U-shaped, rigid metallic hanger or suspending element 16 which serves to suspend the stirrup 10 from an animal such as a horse, e.g., from a saddle mounted on the animal. The hanger 16, which is centered with respect to the footrest 14 laterally of the latter, is provided with a slot 18 for attaching the hanger 16 to the animal.

Figure 3:
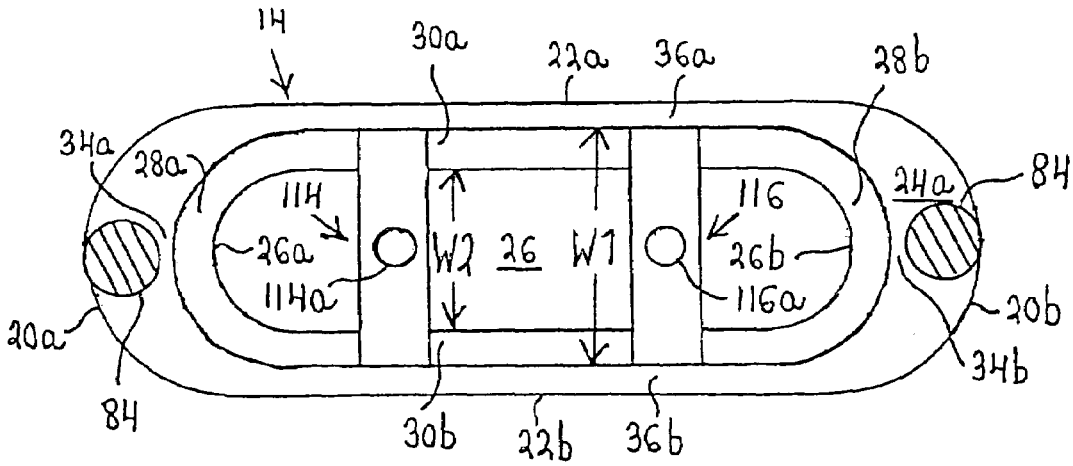
FIG. 3 is a section in the direction of the arrows II—II of FIG. 1 with the shock-absorbing body and the nonslip tread removed to present a top view of the footrest of FIG. 1.
Figure 4:
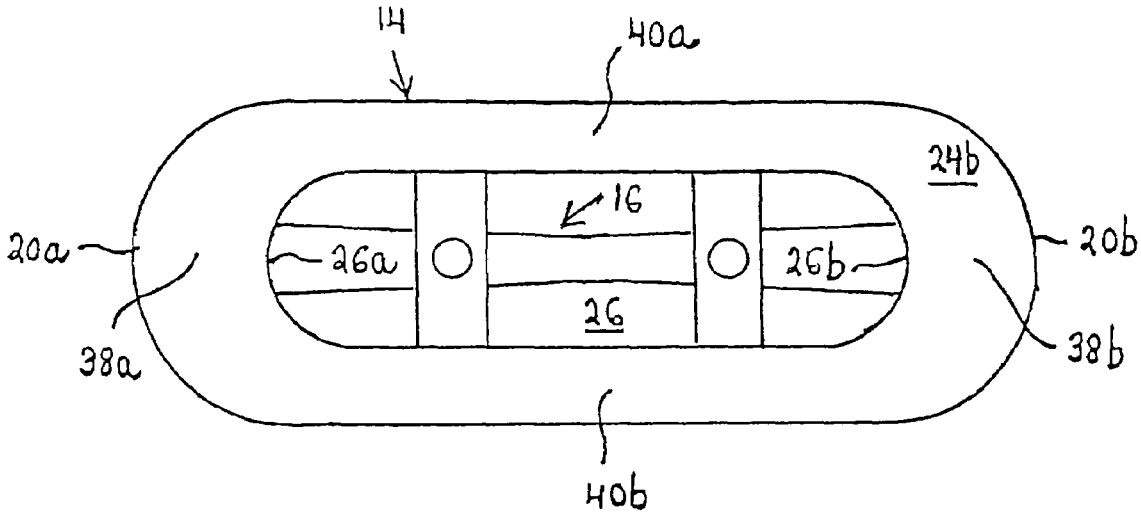
FIG. 4 is a bottom view of the footrest.
Figure 5:
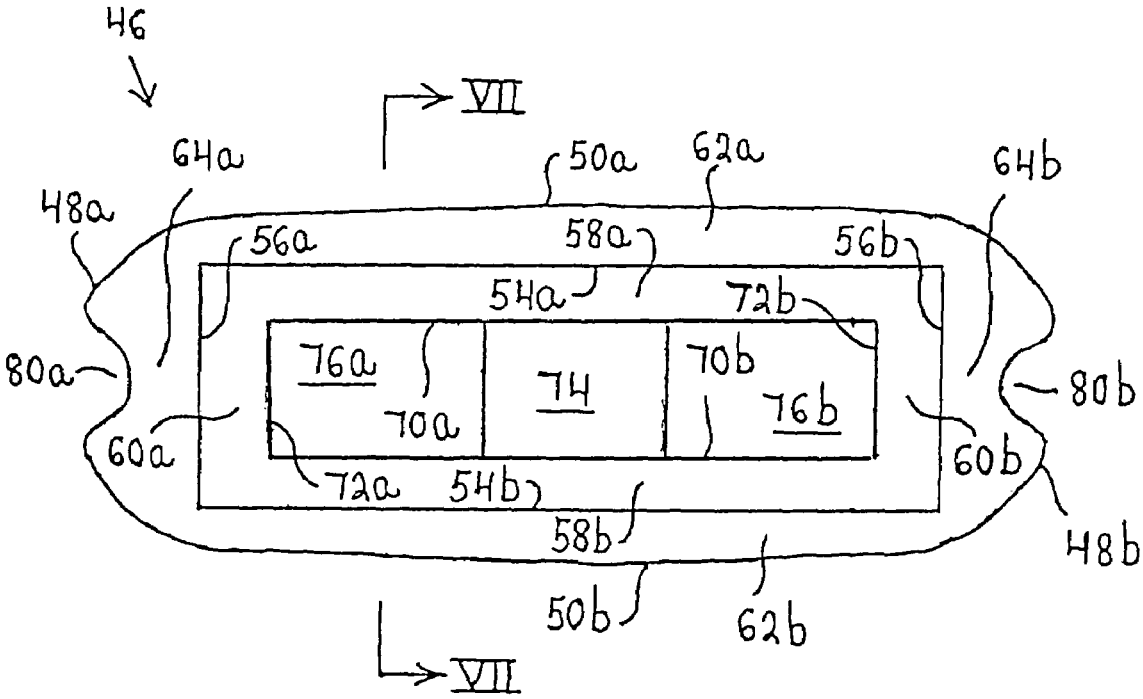
FIG. 5 is a top view of the shock-absorbing body of FIG. 1.
Figure 6:
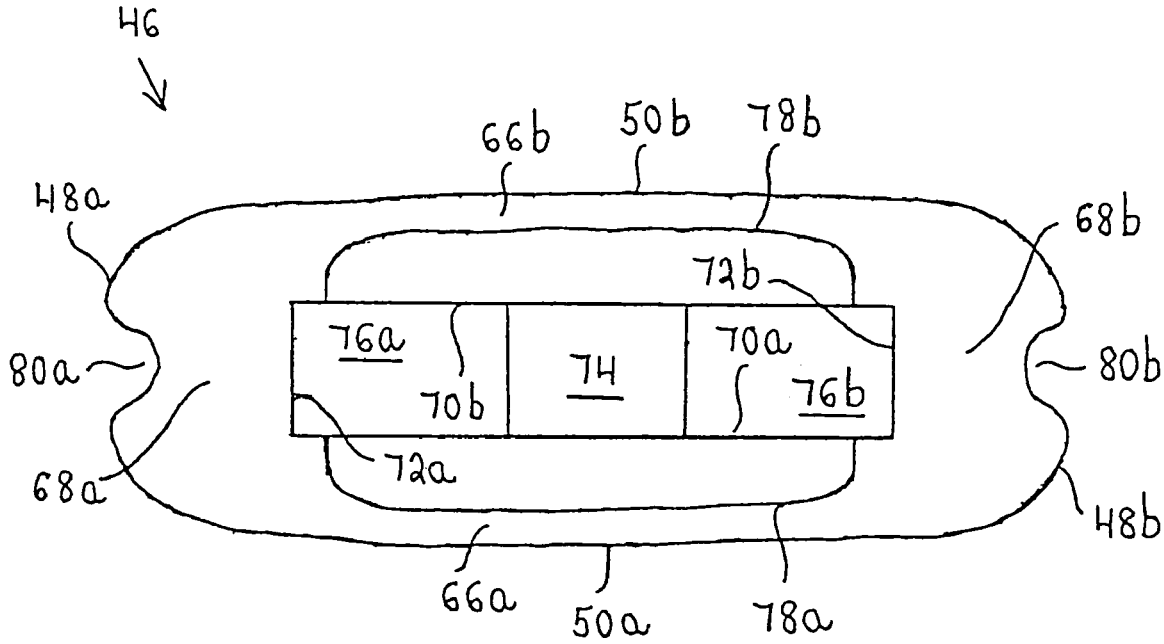
FIG. 6 is a bottom view of the shock-absorbing body of FIG. 5.
Figure 7:
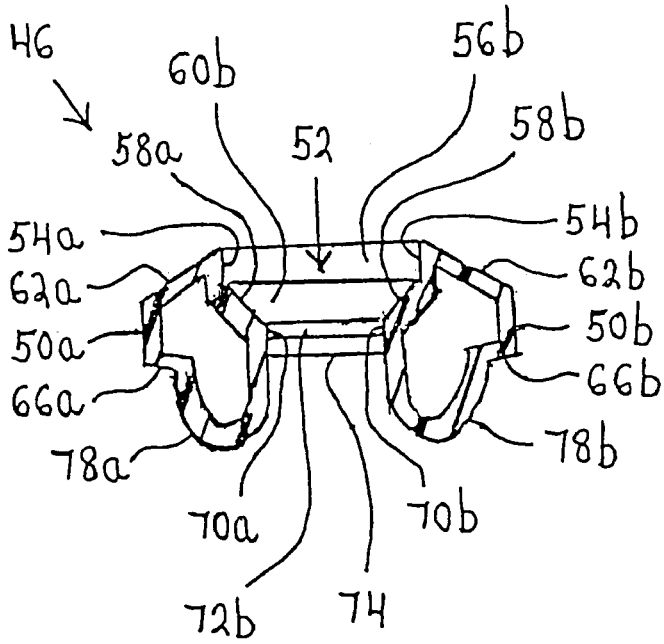
FIG. 7 is a sectional view of the shock-absorbing body of FIG. 5 as seen in the direction of the arrows VII—VII of FIG. 5.

Considering FIGS. 3 and 4 with FIGS. 1 and 2, the footrest 14 is elongated and has opposed longitudinal ends 20*a* and 20*b* which are convex as seen in a plan view. The footrest 14 further has two opposed longitudinally extending sides 22*a* and 22*b* which bridge the longitudinal ends 20*a*,20*b*, and the sides 22*a*,22*b* are straight and parallel to one another. In addition, the footrest 14 has two flat parallel surfaces 24*a* and 24*b* lying in respective planes which are generally perpendicular to the straight sides 22*a* and 22*b*. The flat surfaces 24*a*,24*b* face in opposite directions, and the straight sides 22*a*,22*b* run from one of the flat surfaces 24*a*,24*b* to the other. In use, the flat surface 24*a* faces up and can be considered to be an upper surface of the footrest 14 while the flat surface 24*b* faces down and can be considered to be a lower surface of the footrest 14.

The footrest 14 is formed with an elongated opening 26 having a shape similar to that of the footrest 14. The opening 26 has opposed longitudinal ends 26*a* and 26*b*, and the longitudinal end 26*a* of the opening 26 is located in the vicinity of the longitudinal end 20*a* of the footrest 14 while the longitudinal end 26*b* of the opening 26 is located in the vicinity of the longitudinal end 20*b* of the footrest 14. The elongated opening 26 extends from the upper surface 24*a* of the footrest 14 to the lower surface 24*b* and is bounded by a wall which slopes from the upper surface 24*a* to a location near the lower surface 24*b*. This wall has a concave segment 28*a* at the longitudinal end 26*a* of the opening 26 and a concave segment 28*b* at the longitudinal end 26*b* of the opening 26. The wall bounding the opening 26 further has two opposed segments 30*a* and 30*b* which face each other and run in the same direction as the straight sides 22*a*,22*b* of the footrest 14. Each of the segments 30*a*,30*b* extends from one of the concave segments 28*a*,28*b* to the other.

The wall 28*a*,28*b*,30*a*,30*b* bounding the elongated opening 26 in the footrest 14 slopes in such a manner that the cross-sectional area of the opening 26 at the upper surface 24*a* of the footrest 14 exceeds the cross-sectional area at the lower surface 24*b*. The elongated opening 26 has a maximum width W1 at the upper surface 24*a* and a smaller maximum width W2 at the lower surface 24*b*. Both the cross-sectional area and the maximum width of the elongated opening 26 decrease progressively from the upper surface 24*a* to the location where the wall 28*a*,28*b*,30*a*,30*b* stops sloping.

The upper surface 24*a* of the footrest 14 is made up of two curved sections 34*a* and 34*b* and two straight, strip-like sections 36*a* and 36*b*. The curved sections 34*a*,34*b* are respectively located at the longitudinal ends 26*a*,26*b* of the opening 26 in the footrest 14 while the strip-like sections 36*a*,36*b* run along opposite sides of the opening 26. Each of the strip-like sections 36*a*,36*b* bridges the curved sections 34*a*,34*b*.

In a similar fashion, the lower surface 24*b* of the footrest 14 is made up of two curved sections 38*a* and 38*b* and two straight, strip-like sections 40*a* and 40*b*. The curved sections 38*a*,38*b* are respectively located at the longitudinal ends 26*a*,26*b* of the opening 26 in the footrest 14 while the strip-like sections 40*a*,40*b* run along opposite sides of the opening 26. Each of the strip-like sections 40*a*,40*b* bridges the curved sections 38*a*,38*b*.

Referring to FIGS. 1, 2, 5, 6 and 7, the stirrup 10 comprises an elongated shock-absorbing or cushioning body 46 having opposed longitudinal ends 48*a* and 48*b*. The shock-absorbing body 46 further has two opposed longitudinally extending sides 50*a* and 50*b* which bridge the longitudinal ends 48*a*,48*b*,and the sides 50*a*,50*b* are generally straight and parallel to one another.

The shock-absorbing body 46 is provided with a depression 52 which is bounded by a rectangle including two longer straight surface sections 54*a* and 54*b* and two shorter straight surface sections 56*a* and 56*b*. The longer surface sections 54*a*,54*b* are generally parallel to one another and to the straight sides 50*a*,50*b* of the shock-absorbing body 46. The depression 52 further has a bottom defined by two longer sloping surface sections 58*a* and 58*b* and two shorter sloping surface sections 60*a* and 60*b*. The longer sloping surface sections 58*a*,58*b* run along the respective longer straight surface sections 54*a*,54*b* while the shorter sloping surface sections 60*a*,60*b* run along the respective shorter straight surface sections 56*a*,56*b*.

A sloping surface section 62*a* lies between the straight side 50*a* of the shock-absorbing body 46 and the longer straight surface section 54*a* of the depression 52. Similarly, a sloping surface section 62*b* lies between the straight side 50*b* of the shock-absorbing body 46 and the longer straight surface section 54*b* of the depression 52. The sloping surface sections 62*a*,62*b* bridge the longitudinal ends 48*a*,48*b* of the shock-absorbing body 46, and each of the sloping surface sections 62*a*,62*b* merges into a transverse surface section 64*a* on the longitudinal end 48*a* and a transverse surface section 64*b* on the longitudinal end 48*b*. The transverse surface sections 64*a*,64*b*, which may or may not be sloped, extend transversely of the shock-absorbing body 46 between the sloping surface sections 62*a*,62*b*. The sloping surface sections 62*a*,62*b*, as well as the transverse surface sections 64*a*,64*b*, face upward during use and can thus be considered to constitute upper surface sections of the shock-absorbing body 46.

The shock-absorbing body 46 has two additional surface sections 66*a* and 66*b* which face away from the sloping upper surface sections 62*a*,62*b*. The additional surface sections 66*a*,66*b* bridge the longitudinal ends 48*a*,48*b* of the shock-absorbing body 46, and each of the additional surface sections 66*a*,66*b* merges into a transverse surface section 68*a* on the longitudinal end 48*a* and a transverse surface section 68*b* on the longitudinal end 48*b*. The transverse surface sections 68*a*,68*b* extend transversely of the shock-absorbing body 46 between the additional surface sections 66*a*,66*b*. The additional surface sections 66*a*,66*b*, as well as the transverse surface sections 68*a*,68*b*,face downward during use and can thus be considered to constitute lower surface sections of the shock-absorbing body 46.

An elongated opening is formed centrally of the shock-absorbing body 46 between the sloping surface sections 58*a*,58*b*,60*a*,60*b* of the depression 52 and the lower surface sections 66*a*,66*b*,68*a*,68*b* of the shock-absorbing body 46. The opening, which registers with the depression 52, is bounded by a rectangle including two longer straight surface sections 70*a* and 70*b* and two shorter straight surface sections 72*a* and 72*b*. The longer surface sections 70*a*,70*b* are generally parallel to one another and to the straight sides 50*a*,50*b* of the shock-absorbing body 46.

A crosspiece 74 centered longitudinally of the opening in the shock-absorbing body 46 bridges the longer surface sections 70*a*,70*b* of the opening. The crosspiece 74 divides the opening into two apertures or spaces 76*a* and 76*b*.

The lower surface section 66*a* of the shock-absorbing body 46 is formed with an elongated rib or protuberance 78*a* which extends longitudinally of the shock-absorbing body 46. Likewise, the lower surface section 66*b* of the shock-absorbing body 46 is provided with an elongated rib or protuberance 78*b* which runs longitudinally of the shock-absorbing body 46. The ribs 78*a*,78*b* are arranged so that, when the shock-absorbing body 46 is properly placed on the footrest 14, the rib 78*a* lies proximate to or against the wall segment 30*a* of the opening 26 in the footrest 14 while the rib 78*b* lies proximate to or against the opposing wall segment 30*b*. The length of the rib 78*a* is equal to or less than the length of the wall segment 30*a* of the opening 26 and the length of the rib 78*b* is equal to or less than the length of the wall segment 30*b*. The ribs 78*a*,78*b* serve to position or align the shock-absorbing body 46 on the footrest 14 transversely of the latter.

Figure 8:
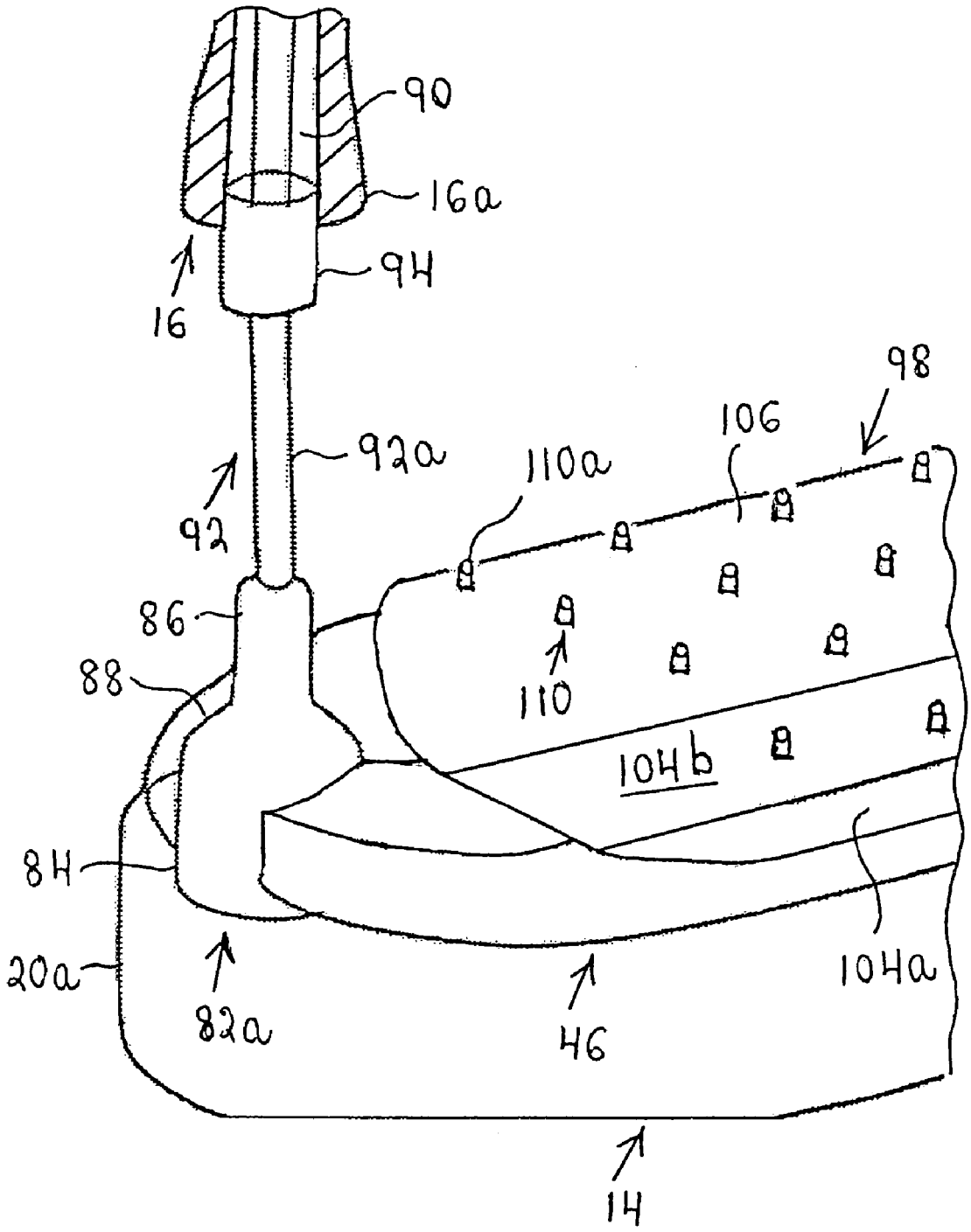
FIG. 8 is an enlarged, fragmentary, partly sectional perspective view of the stirrup of FIG. 1 with a sleeve forming part of the stirrup removed.
Figure 9:
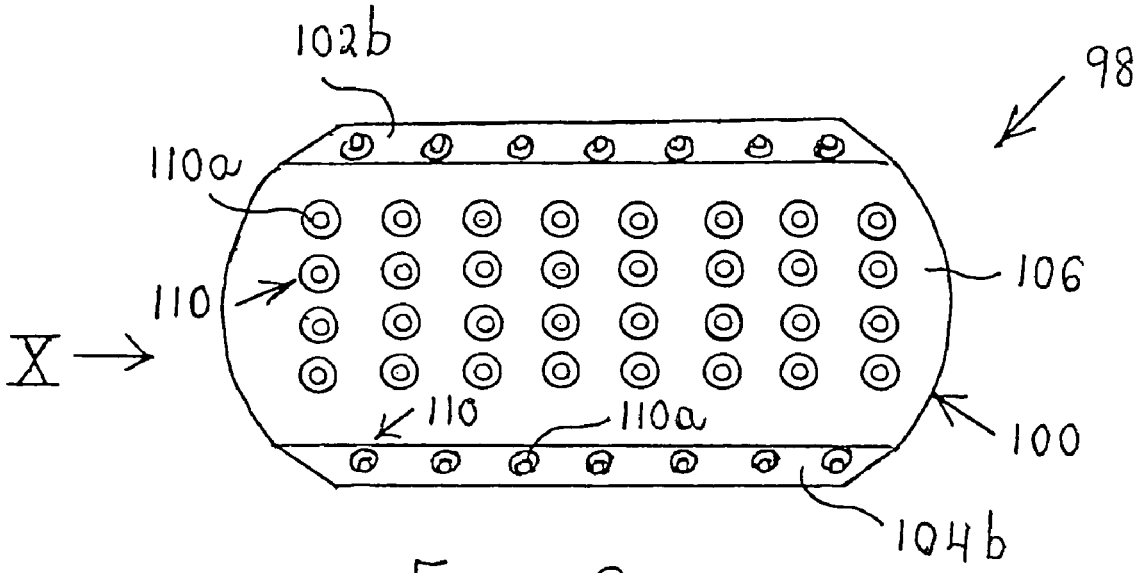
FIG. 9 is a plan view of the nonslip tread of FIG. 1.
Figure 10:
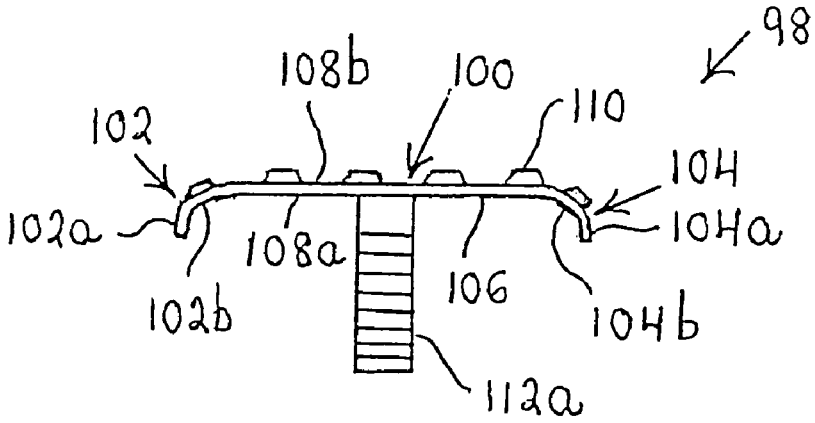
FIG. 10 is an end view of the nonslip tread of FIG. 1 as seen in the direction of the arrow X of FIG. 9.

Turning to FIG. 8 in conjunction with FIGS. 1 and 2, the footrest 14 and the hanger 16 constitute two separate components which are connected to one another flexibly or elastically. The flexible or elastic connection between the footrest 14 and the hanger 16 allows the footrest 14 and the hanger 16 to move relative to each other. In the illustrated embodiment, the flexible or elastic connection is such that the footrest 14 and the hanger 16 can rotate or pivot with respect to one another on an axis parallel to the longitudinal axis of the footrest 14.

The hanger 16 has an end portion 16*a* at the longitudinal end 20*a* of the footrest 14 and another end portion 16*b* at the opposite longitudinal end 20*b* of the footrest 14, and the end portions 16*a*, 16*b* face the footrest 14. The end portion 16*a* of the hanger 16 and the longitudinal end 20*a* of the footrest 14 are joined to each other flexibly or elastically as are the end portion 16*b* of the hanger 16 and the longitudinal end 20*b* of the footrest 14.

An anchoring element 82*a* is mounted on the upper surface 24*a* of the footrest 14 at the longitudinal end 20*a* of the footrest 14 while an anchoring element 82*b* is mounted on the upper surface 24*a* at the longitudinal end 20*b*. As illustrated in FIG. 8 for the anchoring element 82*a*, each of the anchoring elements 82*a*,82*b* includes a cylindrical portion 84 of circular cross section having a larger diameter, a cylindrical portion 86 of circular cross section having a smaller diameter and a frustoconical portion 88 connecting the cylindrical portions 84*a*,84*b* to one another. The larger cylindrical portion 84 of each anchoring element 82*a*,82*b* sits on the upper surface 24*a* of the footrest 14 and serves as a base for the smaller cylindrical portion 86.

The hanger 16 of the stirrup 10 is provided with a passage 90 which runs from the end portion 16*a* of the hanger 16 to the end portion 16*b* thereof. A wire or cable 92 extends through the passage 90 and has opposite end portions 92*a* (only one visible in the drawings) which respectively project from the end portions 16*a*, 16*b* of the hanger 16. Part of each wire end portion 92*a* is embedded in and gripped by the respective anchoring element 82*a*,82*b* so that the wire 92 is anchored to the footrest 14 and establishes a connection between the footrest 14 and the hanger 16.

The end portions 16*a*, 16*b* of the hanger 16 are spaced from the respective anchoring elements 82*a*,82*b* by gaps, and the part of each wire end portion 92*a* which is not embedded in the respective anchoring element 82*a*,82*b* bridges the corresponding gap. The wire 92 is flexible or elastic thereby allowing the parts of the wire 92 between the hanger 16 and the anchoring elements 82*a*,82*b* to bend. When the parts of the wire 92 between the hanger 16 and the anchoring elements 82*a*,82*b* are bent about an axis running parallel to the longitudinal axis of the footrest 14, the footrest 14 and the hanger 16 rotate relative to one another on this axis. The wire 92 can, for example, be made of steel.

The passage 90 of the hanger 16 has a circular cross section and a plug or insert 94 of circular cross section extends into the passage 90 through each of the end portions 16*a*, 16*b* of the hanger 16 (only the plug 94 for the end portion 16*a* is shown in the drawings). Each of the plugs 94 is provided with a channel of circular cross section for the wire 92, and each of the plugs 94 is arranged so that part of the respective plug 94 is located internally of the hanger 16 and part is located externally of the hanger 16. The plugs 94 are fast with the hanger 16 and can be a friction fit in the passage 90 and/or can be attached to the hanger 16 in a suitable manner.

Each of the two parts of the wire 92 spanning the hanger 16 and the anchoring elements 82*a*,82*b* is surrounded by a sleeve or housing 96 of circular cross section, and each of the sleeves 96 is formed with a passage of circular cross section. One end of each sleeve 96 receives the smaller cylindrical portion 86 of the respective anchoring element 82*a*,82*b* while the other end of each sleeve 96 receives the part of the respective plug 94 located externally of the hanger 16. The plugs 94 and the smaller cylindrical portions 86 of the anchoring elements 82*a*,82*b* are fast with the sleeves 96, and the plugs 94 and smaller cylindrical portions 86 can be a friction fit in the sleeves 96 and/or can be attached to the sleeves 96 in a suitable manner.

The sleeves 96 are flexible or elastic thereby allowing the sleeves 96 to bend together with the parts of the wire 92 between the hanger 16 and the anchoring elements 82*a*,82*b*. By virtue of the construction in the illustrated embodiment of the stirrup 10, the sleeves 96 and the parts of the wire 92 spanning the hanger 16 and the anchoring elements 82*a*,82*b* are constrained to bend about an axis running parallel to the longitudinal axis of the footrest 14.

The sleeve 96 at the longitudinal end 20*a* of the footrest 14 may be arranged so that the end of the sleeve 96 which receives the plug 94 butts the end portion 16*a* of the hanger 16 and the end of the sleeve 96 which receives the smaller cylindrical portion 86 of the anchoring element 82*a* butts the larger cylindrical portion 84 of the anchoring element 82*a*. Similarly, the sleeve 96 at the longitudinal end 20*b* of the footrest 14 may be arranged so that the end of the sleeve 96 which receives the plug 94 butts the end portion 16*b* of the hanger 16 and the end of the sleeve 96 which receives the smaller cylindrical portion 86 of the anchoring element 82*b* butts the larger cylindrical portion 84 of the anchoring element 82*b*. The sleeves 96 then bridge the hanger 16 and the anchoring elements 82*a*,82*b* on the footrest 14. The sleeves 96, the larger cylindrical portions 84 of the anchoring elements 82*a*,82*b* and the end portions 16*a*, 16*b* of the hanger 16 can all have the same outer diameter so that a smooth transition from the footrest 14 to the hanger 16 exists at each of the longitudinal ends 20*a*,20*b* of the footrest 14.

The sleeves 96, which constitute cylindrical elements of circular cross section, may be made of material different from that of the footrest 14 and from that of the hanger 16. By way of example, the footrest 14 and the hanger 16 can be made of steel while the sleeves 96 are made of rubber.

Returning to FIGS. 5 and 6 in conjunction with FIG. 1, the shock-absorbing body 46 is provided with a recess or indentation 80*a* at the longitudinal end 48*a* of the shock-absorbing body 46 and with a recess or indentation 80*b* at the longitudinal end 48*b*. The recesses 80*a*,80*b* are centered transversely of the shock-absorbing body 46 and, when the shock-absorbing body 46 is properly placed on the footrest 14, the recess 80*a* receives the larger cylindrical portion 84 of the anchoring element 82*a* whereas the recess 80*b* receives the larger cylindrical portion 84 of the anchoring element 82*b*. The recesses 80*a*,80*b* help to position or align the shock-absorbing body 46 on the footrest 14 transversely of the latter and also serve to confine the shock-absorbing body 46 longitudinally of the footrest 14.

The longitudinal end 48*a* of the shock-absorbing body 46 is convex, as seen in a plan view, between the recess 80*a* and the respective sloping surface sections 62*a*,62*b* of the shock-absorbing body 46. Similarly, the longitudinal end 48*b* of the shock-absorbing body 46 is convex, as seen in a plan view, between the recess 80*b* and each of the sloping surface sections 62*a*,62*b*. Hence, the contours of the longitudinal ends 48*a*,48*b* of the shock-absorbing body 46 conform to the contours of the respective longitudinal ends 20*a*,20*b* of the footrest 14.

The shock-absorbing body 46, or at least the major part thereof, preferably comprises a body inflated with gas. This allows the shock-absorbing body 46 to function as a gas pad or cushion. The shock-absorbing body 46 can be made of plastic and the gas used to inflate the shock-absorbing body 46 may be air. In the illustrated embodiment, all of the shock-absorbing body 46 except for the crosspiece 74 is inflated with gas.

Referring to FIGS. 1, 2, 8 and 9, the stirrup 10 further comprises a nonslip tread or member 98 discrete from the footrest 14 and from the shock-absorbing body 46. The tread 98 includes an elongated sheet-like element or base 100 with opposite longitudinal ends 100*a* and 100*b* having rounded convex edges. The sheet-like element 100 is U-shaped as viewed on end and includes two spaced legs 102 and 104 which run longitudinally of the sheet-like element 100 and are connected to one another by a generally flat crosspiece 106. The sheet-like element 100 has a surface 108*a* which faces inward of the sheet-like element 100 and an opposed surface 108*b* which faces outward of the sheet-like 100. The inward facing surface 108*a* will here be referred to as the inner surface of the sheet-like element 100 while the outward facing surface 108*b* will be referred to as the outer surface of the sheet-like element 100.

The tread 98 is designed to rest on the shock-absorbing body 46 with the longitudinal end 100*a* of the sheet-like element 100 proximate to the longitudinal end 48*a* of the shock-absorbing body 46 and the longitudinal end 100*b* of the sheet-like element 100 proximate to the longitudinal end 48*b* of the shock-absorbing body 46. When the tread 98 is properly positioned on the shock-absorbing body 46, the inner surface 108*a* of the sheet-like element 100 is directed towards the shock-absorbing body 46. The length of the sheet-like element 100 is such that the inner surface 108*a* of the sheet-like element 100 can bear against the transverse surface section 64*a* at the longitudinal end 48*a* of the shock-absorbing body 46 and against the transverse surface section 64*b* at the longitudinal end 48*b* of the shock-absorbing body 46.

The leg 102 of the sheet-like element 100 has a straight flat section 102*a* which is spaced from the crosspiece 106 and lies in a plane normal to the plane of the crosspiece 106. The leg 102 further has a straight flat section 102*b* which bridges the crosspiece 106 and the flat section 102*a* and is sloped relative to the crosspiece 106 and the flat section 102*a*. The leg section 102*a* is designed to lie against the straight side 50*a* of the shock-absorbing body 46 whereas the leg section 102*b* is designed to lie against the sloping surface section 62*a* of the shock-absorbing body 46.

Similarly, the leg 104 of the sheet-like element 100 has a straight flat section 104*a* which is spaced from the crosspiece 106 and is located in a plane normal to the plane of the crosspiece 106. The leg 104 further has a straight flat section 104*b* which spans the crosspiece 106 and the flat section 104*a* and is sloped relative to the crosspiece 106 and the flat section 104*a*. The leg section 104*a* is designed to bear against the straight side 50*b* of the shock-absorbing body 46 whereas the leg section 104*b* is designed to bear against the sloping surface section 62*b* of the shock-absorbing body 46.

The sheet-like element 100 is formed with protrusions 110 which project to the outside of the sheet-like element 100 and cause the tread 98 to be nonslip. Each of the protrusions 110 has a fixed end which is connected to the sheet-like element 100, and each of the protrusions 110 further has a free end which faces away from the sheet-like element 100. The free end of each protrusion 110 is formed with a concavity or depression 110*a*.

The outer surface 108*b* of the sheet-like element 100 is arranged to support the foot of a rider employing the stirrup 10, and the protrusions 110 on the surface 108*b* inhibit the foot of the rider from slipping out of the stirrup 10. This effect is due, at least in part, to the concavities 110*a* in the protrusions 110.

The protrusions 110 can be made of a material having a relatively high coefficient of friction and a nonslip character.

The protrusions 110 may have any of a variety of configurations. By way of example, the protrusions 110 may be frustoconical. The concavities 110*a* in the protrusions 110 are here circular as seen in plan view, and each of the concavities 110*a* is advantageously centered with respect to the respective protrusion 110.

The inner surface 108*a* of the sheet-like element 100 is provided with two threaded studs or projections 112*a* and 112*b*. The studs 112*a*,112*b* are spaced from each other longitudinally of the tread 98 and are centered laterally of the tread 98.

Considering FIGS. 2 and 3, the footrest 14 is formed with two webs or strip-like elements 114 and 116 which are located in the opening 26 of the footrest 14. The webs 114,116 are spaced from one another longitudinally of the footrest 14 and bridge the strip-like sections 36*a*,36*b* thereof. The web 114 is provided with an opening or perforation 114*a* which is centered laterally and longitudinally of the web 114 while the web 116 is provided with an opening or perforation 116*a* which is centered laterally and longitudinally of the web 116. The openings 114*a*,116*a* are spaced from each other by the same distance as the studs 112*a*,112*b* on the tread 98. The opening 114*a* is arranged to be aligned with the aperture 76*a* of the shock-absorbing body 46 whereas the opening 116*a* is arranged to be aligned with the aperture 76*b*.

When the tread 98 is properly positioned on the footrest 14, the stud 112*a* extends through the aperture 76*a* of the shock-absorbing body 46 and through the opening 114*a* of the web 114. In a similar vein, the stud 112*b* passes through the aperture 76*b* of the shock-absorbing body 46 and through the opening 116*a* of the web 116. The studs 112*a*, 112*b* project to the side of the webs 114,116 remote from the shock-absorbing body 46, and the projecting portions of the studs 112*a*,112*b* are of such length that a washer 118 and a nut 120 may be placed on each of these projecting portions. A clamp 122 can be applied to each of the studs 112*a*,112*b* on the side of the respective nut 120 remote from the associated washer 118 to prevent loosening of the nut 120.

Upon tightening the nuts 120, the shock-absorbing body 46 is clamped between the tread 98 and the footrest 14. The tread 98 accordingly serves as an anchoring element for anchoring the shock-absorbing body 46 to the footrest 14.

The webs 114,116 of the footrest 14 can be referred to as anchoring members for the shock-absorbing body 46.

The shock-absorbing body 46, together with the tread 98, may be considered to constitute a nonslip article which inhibits the foot of a rider from slipping out of the stirrup 10.

One manner of assembling the stirrup 10 is as follows:

The hanger 16 with the wire 92 running therethrough is fabricated in a manner known per se as is the footrest 14 with the anchoring elements 82*a*,82*b*. Each of the anchoring elements 82*a*,82*b* is formed with a passage for a respective end portion 92*a* of the wire 92.

Before the end portions 92*a* of the wire 92 are inserted in the anchoring elements 82*a*,82*b*, one of the plugs 94 is placed on each end portion 92*a*. The plugs 94 are advanced to the respective end portions 16*a*, 16*b* of the hanger 16 and pushed into the passage 90 of the hanger 16 so that part of each plug 94 is inside the passage 90 and part of each plug 94 is outside of the passage 90. The plugs 94 are made fast with the hanger 16 by a friction fit in the passage 90 and/or by bonding the plugs 90 to the hanger 16.

Once the plugs 94 are fast with the hanger 16, one of the sleeves 96 is placed on each of the end portions 92*a* of the wire 92. The sleeves 96 are pushed over the respective plugs 94 and into abutment with the respective end portions 16*a*,16*b* of the hanger 16. The sleeves 96 are made fast with the plugs 94 by a friction fit on the plugs 94 and/or by bonding the sleeves 96 to the plugs 94.

After the sleeves 96 have been made fast with the plugs 94, the smaller cylindrical portions 86 of the anchoring elements 82*a*,82*b* are pushed into the respective sleeves 96. As the anchoring elements 82*a*,82*b* advance into the sleeves 96, the end portions 92*a* of the wire 92 enter the passages in the respective anchoring elements 82*a*,82*b*. The anchoring elements 82*a*,82*b* continue to be pushed into the sleeves 96 until the larger cylindrical portions 84 of the anchoring elements 82*a*,82*b* abut the sleeves 96. The sleeves 96 are made fast with the anchoring elements 82*a*,82*b* by a friction fit on the smaller cylindrical portions 86 and/or by bonding the sleeves 96 to the anchoring elements 82*a*,82*b*. The end portions 92*a* of the wire 92 are likewise made fast with the anchoring elements 82*a*,82*b*. This can be accomplished by placing a bonding agent in the passages of the anchoring elements 82*a*,82*b* prior to insertion of the end portions 92*a* of the wire 92 in the passages. Alternatively, the end portions 92*a* of the wire 92 can be bonded to the anchoring elements 82*a*,82*b* by welding or brazing, for example. In such an event, the sleeves 96 are put in place after the end portions 92*a* have been connected to the anchoring elements 82*a*,82*b*. Thus, each of the sleeves 96 is then supplied as two semicylindrical sections which are butted and bonded to one another once the end portions 92*a* of the wire 92 have been secured to the anchoring elements 82*a*,82*b*.

The shock-absorbing body 46 is now placed on the footrest 14. The shock-absorbing body 46 is positioned on the upper surface 24*a* of the footrest 14 with the depression 52 in the shock-absorbing body 46 facing the hanger 16 of the footrest 14. The lower surface section 66*a* of the shock-absorbing body 46 rests on the strip-like section 36*a* of the upper footrest surface 24*a* and the lower surface section 66*b* of the shock-absorbing body 46 rests on the strip-like section 36*b*. In addition, the lower surface section 68*a* of the shock-absorbing body 46 rests on the curved section 34*a* of the upper footrest surface 24*a* whereas the lower surface section 68*b* of the shock-absorbing body 46 rests on the curved section 34*b*.

The ribs 78*a*,78*b* of the shock-absorbing body 46 are inserted in the opening 26 of the footrest 14 with the rib 78*a* running alongside the wall segment 30*a* of the opening 26 and the rib 78*b* running alongside the wall segment 30*b*. Moreover, the anchoring element 82*a* is introduced into the recess 80*a* of the shock-absorbing body 46 while the anchoring element 82*b* is introduced into the recess 80*b*. The ribs 78*a*,78*b* and the recesses 80*a*,80*b* serve to locate the shock-absorbing body 46 on the footrest 14. When the shock-absorbing body 46 is properly situated on the footrest 14, the aperture 76*a* of the shock-absorbing body 46 is aligned with the opening 114*a* in the web 114 of the footrest 14. Likewise, the aperture 76*b* of the shock-absorbing body 46 is aligned with the opening 116*a* in the web 116 of the footrest 14.

After the shock-absorbing body 46 has been placed on the footrest 14, the tread 98 is positioned with the stud 112*a* facing and in register with the aperture 76*a* of the shock-absorbing body 46 and with the stud 112*b* facing and in register with the aperture 76*b* of the shock-absorbing body 46. The studs 112*a*,112*b* are then passed through the respective apertures 76*a*,76*b* and into the openings 114*a*,116*a* of the respective webs 114,116 formed on the footrest 14. The studs 112*a*,112*b* are advanced until the sheet-like element 100 of the tread 98 rests against the shock-absorbing body 46. When the sheet-like element 100 bears against the shock-absorbing body 46, a portion of each stud 112*a*,112*b* projects to the side of the webs 114,116 remote from the shock-absorbing body 46.

The washers 118 are placed on the projecting portions of the studs 112*a*, 112*b* and brought into abutment with the webs 114,116 of the footrest 14. Subsequently, the nuts 120 are screwed onto the studs 112*a*, 112*b* and urged against the washers 118 thereby causing the shock-absorbing body 46 to be clamped between the footrest 14 and the tread 98. After the nuts 120 have been tightened, the clamps 122 are placed on the studs 112*a*,112*b* adjacent to the nuts 120 so as to inhibit loosening of the nuts 120.

To use the stirrup 10, a saddle is secured to an animal, such as a horse, which is suited for riding. A strap is passed through the slot 18 of the hanger 16 and attached to the saddle after which a rider places his or her foot on the tread 98 and swings into the saddle. Once the rider is in the saddle and urges the animal to move, the rider's foot tends to pivot back-and-forth. This tendency causes the footrest 14 to rotate or pivot elastically relative to the hanger 16 on an axis which is parallel to the longitudinal axis of the footrest 14.

FIGS. 11–14 illustrate another embodiment of a stirrup in accordance with the invention.

Figure 11:
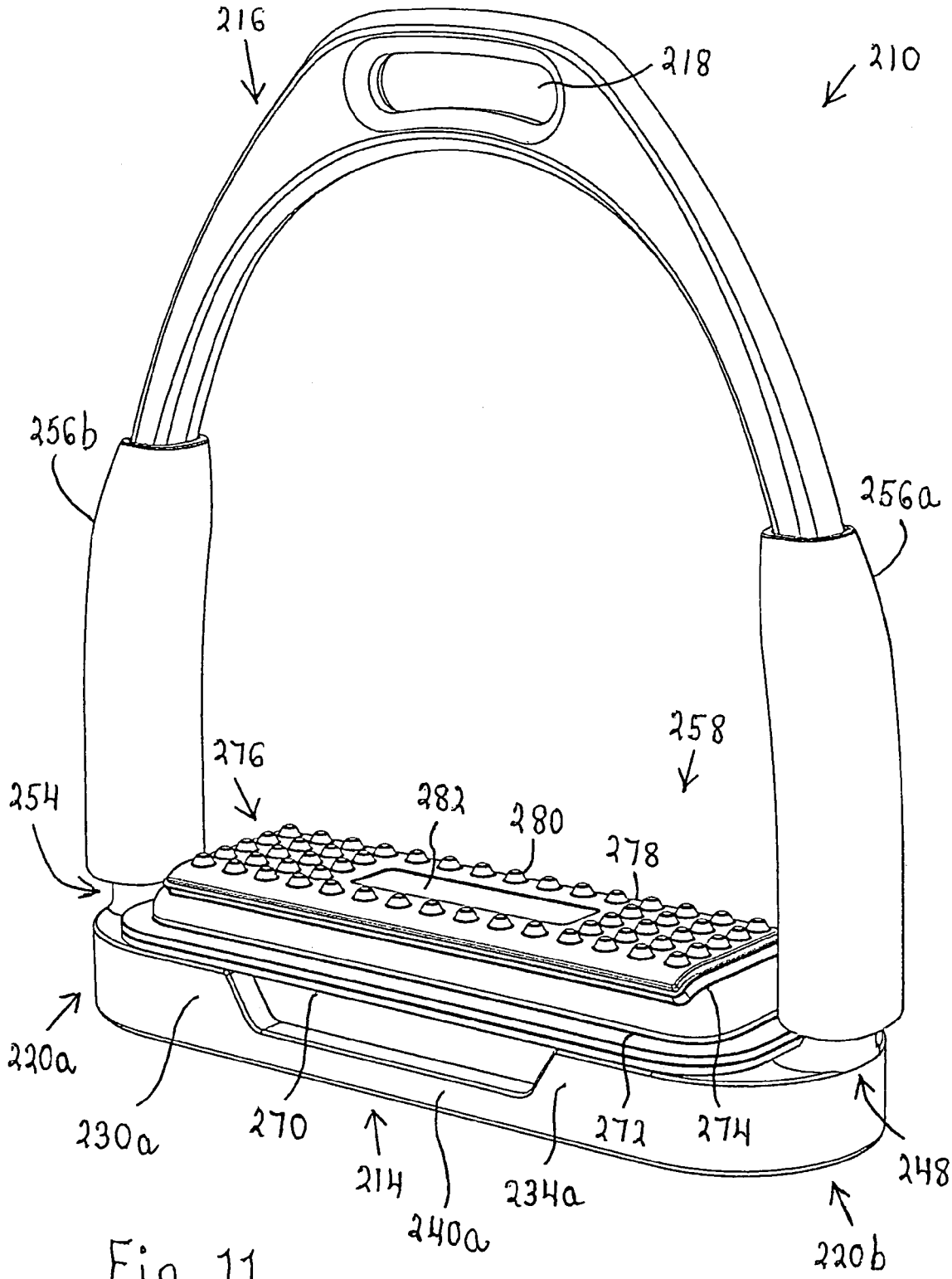
FIG. 11 is a perspective view of another embodiment of a stirrup which is designed in accordance with the invention and includes a footrest, a shock-absorbing body on the footrest and a nonslip tread overlying the shock-absorbing body.
Figure 12:
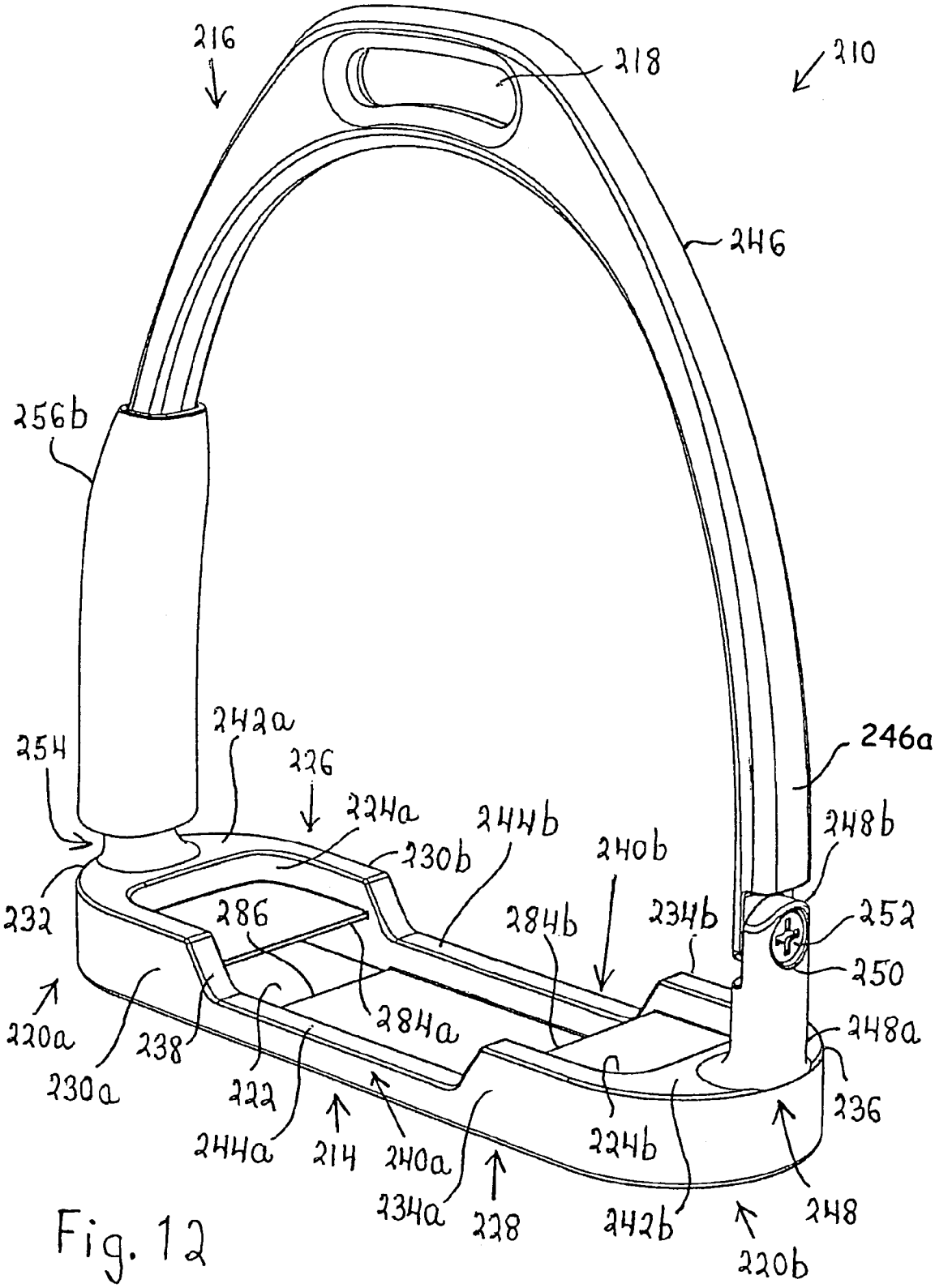
FIG. 12 is a perspective view of the stirrup of FIG. 11 with the shock-absorbing body, the nonslip tread and a sleeve forming part of the stirrup removed.

In FIGS. 11 and 12, the stirrup is identified by the numeral 210. The stirrup 210 includes a rigid metallic footrest 214 which constitutes a support for a foot and a U-shaped, rigid metallic hanger or suspending element 216 which serves to suspend the stirrup 210 from an animal such as a horse, e.g., from a saddle mounted on an animal. The hanger 216, which is centered with respect to the footrest 214 laterally of the latter, is provided with a slot 218 for attaching the hanger 216 to the animal. Unlike the hanger 16 of the stirrup 10 which is provided with a passage 90 for the wire 92, the hanger 216 of the stirrup 210 has a solid cross section throughout except for the portion of the hanger 216 containing the slot 218.

The footrest 214 is elongated and has opposed longitudinal ends 220*a* and 220*b* which are convex as seen in a plan view of the footrest 214. The footrest 214 is formed with an opening 222 which is elongated in the same direction, and has the same shape, as the footrest 214. The opening 222, which is centered laterally and longitudinally of the footrest 214, has opposed longitudinal ends 224*a* and 224*b*.

The longitudinal ends 220*a*,220*b* of the footrest 214 are U-shaped as seen in a plan view of the footrest 214, and the longitudinal ends 220*a*,220*b* of the footrest 214 respectively accommodate the longitudinal ends 224*a*,224*b* of the opening 222.

The footrest 214 has a side 226 which faces up during use and an opposite side 228 which faces down during use. The side 226 may thus be referred to as the upper side of the footrest 214 whereas the side 228 may be referred to as the lower side of the footrest 214.

The U-shaped longitudinal end 220*a* of the footrest 214 has two legs 230*a* and 230*b* as well as a crosspiece 232 which bridges the legs 230*a*,230*b*. Similarly, the U-shaped longitudinal end 220*b* of the footrest 214 has two legs 234*a* and 234*b* plus a crosspiece 236 which bridges the legs 234*a*,234*b*. The leg 230*a* of the longitudinal end 220*a* and the leg 234*a* of the longitudinal end 220*b* are aligned with one another longitudinally of the footrest 214 and are spaced from each other. The same is true for the leg 230*b* of the longitudinal end 220*a* and the leg 234*b* of the longitudinal end 220*b*.

Each of the legs 230*a*,230*b*,234*a*,234*b* has an end face 238 which extends from the upper side 226 of the footrest 214 partway to the lower side 228. The end face 238 of the leg 230*a* and the end face 238 of the longitudinally aligned leg 234*a* are bridged by a bar 240*a* forming part of the footrest 214 while the end face 238 of the leg 230*b* and the end face 238 of the longitudinally aligned leg 234*b* are bridged by a bar 240*b* also forming part of the footrest 214. The bars 240*a*,240*b*, which have a smaller thickness than the longitudinal ends 220*a*,220*b* of the footrest 214, are parallel to one another.

The longitudinal ends 220*a*,220*b* of the footrest 214 have respective upper surfaces 242*a* and 242*b* which are flat and lie in a common plane. The lower side 228 of the footrest 214 is likewise flat and defines a plane which is parallel to the plane of the upper surfaces 242*a*,242*b*. The bars 240*a*, 240*b* of the footrest 214 have respective upper surfaces 244*a* and 244*b* which are also flat and are again located in a common plane. The plane of the upper surfaces 244*a*,244*b* of the bars 240*a*,240*b* is parallel to, and located between, the plane of the lower side 228 of the footrest 214 and the plane of the upper surfaces 242*a*,242*b* of the longitudinal ends 220*a*,220*b* of the footrest 214.

The footrest 214 and the hanger 216 constitute two separate components which are connected to each other such that the footrest 214 and the hanger 216 can move relative to one another. More particularly, the footrest 214 and the hanger 216 are rotatable or pivotable with respect to each other on an axis which runs in the direction of elongation, and is parallel to the longitudinal axis, of the footrest 214.

The hanger 216 has two end portions and a U-shaped main portion 246 which bridges the end portions. Only one end portion of the hanger 216 is visible in the drawings. The non-visible end portion of the hanger 216 confronts the longitudinal end 220*a* of the footrest 214 while the visible end portion of the hanger 216, seen in FIG. 12, confronts the longitudinal end 220*b* of the footrest 214. The footrest 214 is connected to the end portions of the hanger 216 and the same connection is used at each of these end portions. This connection will be described with reference to the visible end portion of the hanger 216.

Considering FIG. 12, the visible end portion of the hanger 216 is denoted by the numeral 246*a*. The cross section of the end portion 246*a* of the hanger 216 is smaller than the cross section of the main portion 246 of the hanger 216, and the end portion 246*a* is in the form of a flat tongue or tab which projects from the main portion 246 axially thereof. The end portion 246*a* confronts the longitudinal end 220*b* of the footrest 214 as mentioned previously and is spaced from the longitudinal end 220*b*.

An anchoring element 248 is mounted on the upper surface 242*b* of the longitudinal end 220*b* of the footrest 214. The anchoring element 248 is situated on the crosspiece 236 of the longitudinal end 220*b* and is centered with respect to the legs 234*a*,234*b* of the longitudinal end 220*b*. The anchoring element 248 comprises a pedestal or base 248*a* which sits on the longitudinal end 220*b* of the footrest 214, and the anchoring element 248 further comprises a bearing member 248*b* which is supported by the pedestal 248*a* at an end of the pedestal 248*a* remote from the longitudinal end 220*b*. The bearing member 248*b* has a cross section which is smaller than that of the pedestal 248*a*.

The bearing member 248*b* of the anchoring element 248 is located adjacent to and faces the end portion 246*a* of the hanger 216. The bearing member 248*b* is provided with a passage 250 which registers with a non-illustrated passage in the end portion 246*a* of the hanger 216. A pivot pin or bearing element 252 is mounted in the passage 250 of the bearing member 248*b* and the registering passage of the end portion 246*a*, and the pivot pin 252 pivotally connects the end portion 246*a* and the bearing member 248*b* to one another.

The axis of the pivot pin 252 extends in the direction of elongation, and is parallel to the longitudinal axis, of the footrest 214. Furthermore, the pivot pin 252 is coaxial with a non-illustrated pivot pin connecting the non-visible end portion of the hanger 216 to an anchoring element 254 on the longitudinal end 220*a* of the footrest 214. Consequently, the footrest 214 and the hanger 216 are pivotable or rotatable relative to one another on an axis extending in the direction of elongation, and paralleling the longitudinal axis, of the footrest 214.

Referring to FIG. 11 in conjunction with FIG. 12, the joint formed by the pivot pin 252, the end portion 246*a* of the hanger 216 and the bearing member 248*b* of the anchoring element 248 is surrounded by a sleeve or housing 256*a* which functions to protect the joint. One end of the sleeve 256*a* sits on the pedestal 248*a* of the anchoring element 248 while the other end of the sleeve 256*a* sits on the main portion 246 of the hanger 216 at a location between the slot 218 and the pivot pin 252.

A sleeve or housing 256*b* similar to the sleeve 256*a* surrounds the joint formed between the footrest 214 and the hanger 216 at the longitudinal end 220*a* of the footrest 214.

The sleeves 256*a*,256*b* are flexible or elastic thereby allowing the sleeves 256*a*,256*b* to bend as the footrest 214 and the hanger 216 pivot relative to one another. By way of example, the sleeves 256*a*,256*b* can be made of rubber.

Figure 13:
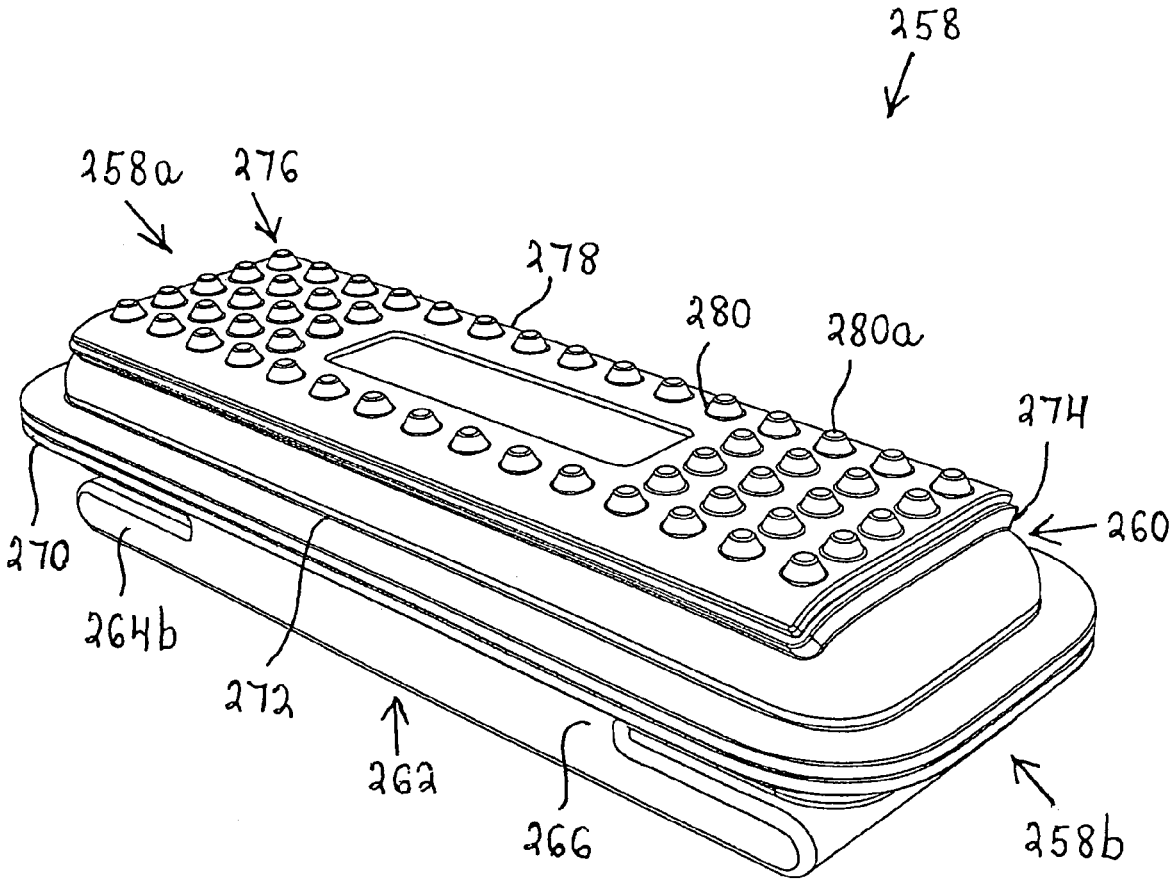
FIG. 13 is a perspective view of the shock-absorbing body and nonslip tread of the stirrup of FIG. 11.
Figure 14:
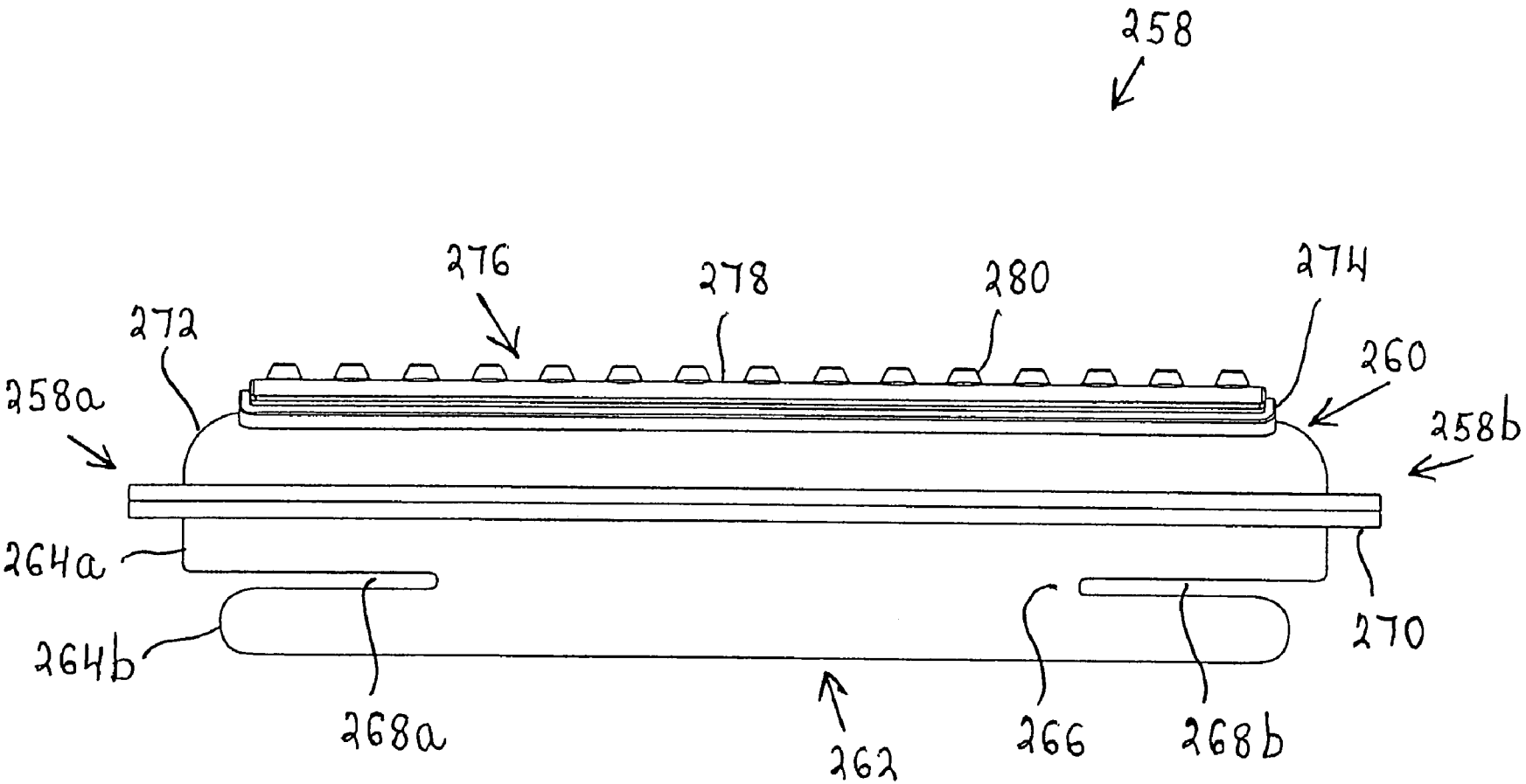
FIG. 14 is a side view of the shock-absorbing body and nonslip tread of the stirrup of FIG. 11.

Considering FIGS. 11, 13 and 14, the stirrup 210 additionally includes a nonslip article 258 which is discrete from and anchored to the footrest 214. The nonslip article 258 is elongated and has opposed longitudinal ends 258*a* and 258*b*.

The nonslip article 258 includes an elongated body 260 which serves as a shock-absorbing or cushioning element for the foot of a rider and also functions to anchor the nonslip article 258 to the footrest 214. The shock-absorbing body 260 defines one or more substantially leakproof chambers containing gas, and the shock-absorbing body 260 is designed in such a manner that at least the major part of the nonslip article 258 is inflated with gas. The gas used to inflate the shock-absorbing body 260 is preferably air.

The shock-absorbing body 260 includes a section 262 which is used to anchor the nonslip article 258 to, and to position the nonslip article 258 on, the footrest 214. As best seen in the side view of FIG. 14, this anchoring and positioning section 262 comprises two layers 264*a* and 264*b* which are joined to one another by a relatively thin neck or constriction 266. The neck 266 is centered lengthwise of the layers 264*a*,264*b* and has a length less than that of either layer 264*a*,264*b*. Thus, a portion of each layer 264*a*,264*b* projects to one side of the neck 266 and another portion of each layer 264*a*,264*b* projects to the other side of the neck 266. The projecting portions of the layers 264*a*,264*b* on the one side of the neck 266 define a slot or space 268*a* at the longitudinal end 258*a* of the nonslip article 258 while the projecting portions of the layers 264*a*,264*b* on the other side of the neck 266 define a slot or space 268*b* at the longitudinal end 258*b* of the nonslip article 258. The slot 268*a* opens to the sides and to the longitudinal end 258*a* of the nonslip article 258 whereas the slot 268*b* opens to the sides and to the longitudinal end 258*b* of the nonslip article 258. The slots 268*a*,268*b* are planar and are located in a common plane.

The contours of the layers 264*a*,264*b* of the shock-absorbing body 260 are at least approximately the same as the contour of the opening 222 in the footrest 214. When the nonslip article 258 is properly positioned on the footrest 214, the layers 264*a*,264*b* of the shock-absorbing body 260 are located in the opening 222 of the footrest 214 with the layer 264*a* above the layer 264*b*. As illustrated in FIG. 14, the length of the upper layer 264*a* is somewhat greater than the length of the lower layer 264*b*, and the length of the upper layer 264*a* is selected in such a manner that the upper layer 264*a* fits snugly in the opening 222 of the footrest 214 lengthwise of the opening 222. On the other hand, the upper layer 264*a* and the lower layer 264*b* have the same width and this width is chosen so that both the upper layer 264*a* and the lower layer 264*b* fit snugly in the opening 222 widthwise of the latter.

Referring once again to FIG. 13 in conjunction with FIG. 14, the shock-absorbing body 260 further includes a section 270 which adjoins the upper layer 264*a*. The section 270 is in the form of a generally flat rim or flange which is circumferentially complete, that is, which extends along the entire periphery of the shock-absorbing body 260. The rim 270, which has a contour resembling that of the opening 222 in the footrest 214, is designed to rest on the upper surfaces 242*a*,242*b* of the footrest 214 when the nonslip article 258 is properly situated on the footrest 214. To this end, the length of the rim 270 exceeds the length of the opening 222 in the footrest 214 and is equal to or less than the distance between the anchoring element 248 at the longitudinal end 220*b* of the footrest 214 and the anchoring element 254 at the longitudinal end 220*a*. The width of the rim 270 is greater than the width of the opening 222 and preferably does not exceed the width of the footrest 214.

The shock-absorbing body 260 additionally includes a section 272 which projects to the side of the rim 270 remote from the layers 264*a*,264*b* of the shock-absorbing body 260. The projecting section 272, which again has a contour similar to that of the opening 222 in the footrest 214, has the same, or approximately the same, dimensions as the upper layer 264*a* of the shock-absorbing body 260. When the stirrup 210 is in use and the nonslip article 258 is in proper position on the footrest 214, the projecting section 272 of the shock-absorbing body 260 sits above the upper surfaces 242*a*,242*b* of the footrest 214.

The projecting section 272 of the shock-absorbing body 260 has a side which faces away from the rim 270 and is directed upward during use, and a generally rectangular sheet-like support 274 is secured to this side of the projecting section 272. The sheet-like support 274, which has smaller dimensions than the projecting section 272, serves as a carrier for a nonslip tread or member 276.

The tread 276 comprises a generally rectangular sheet-like support or base 278 which is preferably flexible or resilient and has approximately the same dimensions as the sheet-like carrier 274. The sheet-like element 278 has a major surface which faces away from the sheet-like carrier 274 and is directed upward when the stirrup 210 is in use and the nonslip article 258 is properly situated on the footrest 214. Such surface is provided with a multiplicity of protrusions 280 which are intended to bear against the boot sole of a rider employing the stirrup 210, and each of the protrusions 280 has a fixed end which is connected to this surface of the sheet-like element 278. Each of the protrusions 280 further has a free end which faces away from the sheet-like element 278, and the free end of each protrusion 280 is formed with a concavity or depression 280*a*. The protrusions 280 inhibit the foot of the rider from slipping out of the stirrup 210 and this effect is due, at least in part, to the concavities 280*a* in the protrusions 280. In particular, the resilience of the material making up the protrusions 280 in combination with the concavities 280*a* produce a suction effect upon any surface bearing upon them, thereby further increasing the gripping performance of the nonslip article 258 of the invention. Because of the relatively small size of the protrusions 280 (preferably about 2.5 mm at the top edge), they can adhere to and therefore act as a suction cup even on relatively non-uniform surfaces, such as the typical soles of riding boots.

The protrusions 280 are preferably composed of a flexible or resilient material having a relatively high coefficient of friction and a nonslip character. For instance, the protrusions 280 can be made of rubber. The protrusions 280 may be integral with the sheet-like element 278.

The protrusions 280 may have any of a variety of configurations. For instance, the protrusions 280 may be frustoconical as illustrated in FIGS. 13 and 14. The concavities 280*a* in the protrusions 280 are here circular as seen in plan view, and each of the concavities 280*a* is advantageously centered with respect to the respective protrusion 280.

The tread 276 may be releasably attached to the sheet-like carrier 274, e.g., by way of hook-and-loop fastening means. Releasable attachment of the tread 276 to the sheet-like carrier 274 enables the tread 276 to be replaced when the tread 276 becomes worn or damaged.

The tread 276 is provided with a generally rectangular cutout 282 which exposes a portion of the underlying sheet-like carrier 274. Such portion of the sheet-like carrier 274 can be provided with one or more indicia forming a logo or a legend, for example.

Returning to FIG. 12, the longitudinal end 224*a* of the opening 222 in the footrest 214 accommodates a platform or crosspiece 284*a* while the longitudinal end 224*b* of the opening 222 accommodates a platform or crosspiece 284*b*. The platforms 284*a*,284*b*, which are flat and sheet-like, lie in a common plane located between the plane of the lower side 228 of the footrest 214 and the plane of the upper surfaces 242*a*,242*b* of the footrest 214. The platform 284*a* is fixed to the legs 230*a*,230*b* and the crosspiece 232 of the longitudinal end 220*a* of the footrest 214 whereas the platform 284*b* is fixed to the legs 234*a*,234*b* and the crosspiece 236 of the longitudinal end 220*b* of the footrest 214.

The platforms 284*a*,284*b* serve as anchoring members for fixing the nonslip article 258 on the footrest 14.

Another platform or crosspiece 286 is disposed in the opening 222 of the footrest 214 and is centered longitudinally of the opening 222. The platform 286 is again flat and sheet-like, and the platform 286 is parallel to the plane of the platforms 284*a*,284*b* and is located on the side of such plane remote from the upper surfaces 242*a*,242*b* of the footrest 214. The platform 286 is preferably positioned so that the surface thereof which faces away from the upper surfaces 242*a*,242*b* of the footrest 214 is coplanar with the lower side 228 of the footrest 214. The platform 286, which functions as a rest or supporting member for the nonslip article 258, is fixed to the bars 240*a*,240*b* bridging the longitudinal ends 220*a*,220*b* of the footrest 214.

The nonslip article 258 is flexible so that the nonslip article 258 can be bent in order to mount the nonslip article 258 on the footrest 214. One manner of mounting the nonslip article 258 on the footrest 214 is to place the longitudinal end 258*a* of the nonslip article 258 between the bars 240*a*,240*b* of the footrest 214. The longitudinal end 258*a* is positioned with an adjoining portion of the lower layer 264*b* of the nonslip article 258 bearing against the rest 286 of the footrest 214 and with the slot 268*a* of the nonslip article 258 facing the anchoring member 284*a* of the footrest 214. The nonslip article 258 can then be slid towards the anchoring member 284*a* thereby allowing the latter to enter the slot 268*a*. Once the anchoring member 284*a* is received in the slot 268*a*, the nonslip article 258 can be bent in a manner which permits the other anchoring member 284*b* of the footrest 214 to enter the slot 268*b* of the nonslip article 258.

As indicated earlier, the lower layer 264*b* of the nonslip article 258 is somewhat shorter than the upper layer 264*a*. This makes it easier to insert one of the anchoring members 284*a*,284*b* of the footrest 214 in the respective slot 268*a*, 268*b* of the nonslip article 258 after the other anchoring member 284*a*,284*b* has been received in the corresponding slot 268*a*,268*b*.

The nonslip article 258 can be readily removed from the footrest 214 by pulling the central portion of the nonslip article 258 away from the footrest 214. This action will cause the slots 268*a*,268*b* of the nonslip article 258 to retract from the respective anchoring members 284*a*,284*b* of the footrest 214. Release of the nonslip article 258 from the footrest 214 is facilitated by the fact that the lower layer 264*b* of the nonslip article 258 is shorter than the upper layer 264*a*.

When the nonslip article 258 is properly anchored to the footrest 214, the anchoring members 284*a*,284*b* are in the respective slots 268*a*,268*b*. The upper layer 264*a* and the lower layer 264*b* of the nonslip article 258 are located in the opening 222 of the footrest 214 with the lower layer 264*b* bearing against the rest 286 of the footrest 214. The rim 270 of the nonslip article 258 rests on the upper surfaces 242*a*, 242*b* of the respective longitudinal ends 220,220*b* of the footrest 214.

As seen in FIG. 11, a gap is present between the rim 270 of the nonslip article 258 and the bar 240*a* of the footrest 214. A similar gap is present between the rim 270 and the opposite bar 240*b* of the footrest 214. These gaps, which exist because the bars 240*a*,240*b* are thinner than the longitudinal ends 220*a*,220*b* of the footrest 214 on which the rim 270 sits, make it easier to grip the nonslip article 258 for removal from the footrest 214.

Various modifications are possible within the meaning and range of equivalence of the appended claims.

I claim:

1. A nonslip article for the footrest of a stirrup comprising:

a base;

a plurality of protrusions on said base, each of said protrusions having a first end connected to said base and a second end facing away from said base, and each of said second ends being provided with a depression; and an inflatable body having means for anchoring said body to the footrest of a stirrup, said base being designed to be mounted on said body;

wherein at least a major part of said inflatable body is inflated with gas.

2. The article of claim 1, wherein said protrusions are substantially frustoconical.

3. The article of claim 1, wherein said base is flexible.

4. The article of claim 1, wherein said gas comprises air.

5. The article of claim 1, wherein said anchoring means comprises at least one space.

6. The article of claim 5, wherein said space is a slot.

7. The article of claim 1, wherein said body is elongated and has opposite longitudinal ends, said anchoring means including a space at each of said ends.

8. The article of claim 1, wherein said body comprises at least one rib for positioning said body on the footrest of a stirrup.

9. The article of claim 1, wherein said body is provided with at least one recess for positioning said body on the foot rest of a stirrup.

10. The article of claim 1, wherein said body comprises a flange for positioning said body on the footrest of a stirrup.

11. A stirrup comprising:

a support for a foot;

a suspending element for suspending said support on an animal; and a nonslip article on said support, said nonslip article including a base and a plurality of protrusions on said base, each of said protrusions having a first end connected to said base and a second end facing away from said base, and each of said second ends being provided with a depression; and an inflatable body having means for anchoring said body to a footrest of the stirrup, said base being designed to be mounted on said body;

wherein at least a major part of said inflatabe body is inflated with gas.

12. The stirrup of claim 11, wherein said protrusions are substantially frustoconical.

13. The stirrup of claim 11, wherein said base is flexible.

14. The stirrup of claim 11, wherein said gas comprises air.

15. The stirrup of claim 11, wherein said anchoring means comprises at least one space.

16. The stirrup of claim 15, wherein said space is a slot.

17. The stirrup of claim 11, wherein said body is elongated and has opposite longitudinal ends, said anchoring means including a space at each of said ends.

18. The stirrup of claim 11, wherein said body comprises at least one rib for positioning said body on the footrest of a stirrup.

19. The stirrup of claim 11, wherein said body is provided with at least one recess for positioning said body on the footrest of a stirrup.

20. The stirrup of claim 11, wherein said body comprises a flange for positioning said body on the footrest of a stirrup.

* * * * *